US008743008B2

(12) United States Patent
Kim et al.

(10) Patent No.: US 8,743,008 B2
(45) Date of Patent: Jun. 3, 2014

(54) RECONFIGURABLE BASE STATION ANTENNA

(75) Inventors: In-Ho Kim, Yongin-si (KR); Jae-Jun Lee, Seongnam-si (KR); Kee-Bum Kim, Suwon-si (KR); Chang-Woo Yoo, Suwon-si (KR)

(73) Assignee: KMW Inc., Hwaseong-si (KR)

( * ) Notice: Subject to any disclaimer, the term of this patent is extended or adjusted under 35 U.S.C. 154(b) by 130 days.

(21) Appl. No.: 13/517,088

(22) PCT Filed: Dec. 21, 2010

(86) PCT No.: PCT/KR2010/009175
§ 371 (c)(1),
(2), (4) Date: Jun. 19, 2012

(87) PCT Pub. No.: WO2011/078565
PCT Pub. Date: Jun. 30, 2011

(65) Prior Publication Data

US 2012/0280874 A1 Nov. 8, 2012

(30) Foreign Application Priority Data

Dec. 21, 2009 (KR) ..... 10-2009-0128482

(51) Int. Cl.
*H01Q 21/12* (2006.01)

(52) U.S. Cl.
USPC ..... 343/812; 343/757; 343/766; 343/882

(58) Field of Classification Search
USPC ..... 343/757, 766, 810, 812, 813, 882
See application file for complete search history.

(56) References Cited

U.S. PATENT DOCUMENTS

| | | | | |
|---|---|---|---|---|
| 4,692,094 | A | 9/1987 | Kulinyak | |
| 5,111,214 | A * | 5/1992 | Kumpfbeck et al. | 343/841 |
| 5,440,318 | A * | 8/1995 | Butland et al. | 343/814 |
| 5,469,181 | A * | 11/1995 | Yarsunas | 343/815 |
| 5,710,569 | A * | 1/1998 | Oh et al. | 343/817 |
| 5,724,051 | A * | 3/1998 | Mailandt et al. | 343/795 |
| 7,015,871 | B2 * | 3/2006 | Gottl et al. | 343/882 |
| 8,018,390 | B2 | 9/2011 | Davidson et al. | |
| 2009/0135076 | A1 | 5/2009 | Foo | |
| 2009/0312057 | A1 | 12/2009 | Moon et al. | |

FOREIGN PATENT DOCUMENTS

CN 1697560 A 11/2005

(Continued)

OTHER PUBLICATIONS

European Search Report issued Sep. 26, 2012 in counterpart European Patent Application No. 10839762.1 (6 pages, in English).

(Continued)

*Primary Examiner* — Tho G Phan
(74) *Attorney, Agent, or Firm* — NSIP Law

(57) ABSTRACT

The invention relates to a base station antenna, that includes two or more reflector plates, each provided with a radiating element. The base station antenna also includes a reflector plate connecting member connected to each reflector plate for enabling the rotation of the reflector plates. The base station antenna also includes a reflector plate controller providing control signals for controlling the rotation and stoppage of the reflector plates.

14 Claims, 10 Drawing Sheets

(56) References Cited

FOREIGN PATENT DOCUMENTS

| | | | |
|---|---|---|---|
| JP | 57-5014790 | | 10/1982 |
| JP | 60-49305 | | 4/1985 |
| JP | 9-260936 | | 10/1997 |
| JP | 2005-184769 | | 7/2005 |
| JP | 2009-533010 | | 9/2009 |
| JP | 2011-52468 | | 3/2011 |
| KR | 10-2005-0064401 | A | 6/2005 |
| KR | 10-2007-0049459 | A | 5/2007 |
| KR | 10-2007-0062890 | A | 6/2007 |
| WO | WO 2005/062419 | A1 | 7/2005 |
| WO | WO 2007/069809 | A1 | 6/2007 |

OTHER PUBLICATIONS

International Search Report for PCT/KR2010/009175 including Notification of Transmittal of the International Search Report and Written Opinion (7 pages in Korean).
Japanese Office Action issued Jul. 30, 2013 in counterpart Japanese Patent Application No. JP2012-544403 (2 pages, in Japanese).
Chinese Office Action issued Nov. 21, 2013 in counterpart Chinese Patent Application No. 201080058621.5 (22 pages, in Chinese with English Translation).
Japanese Office Action issued Dec. 10, 2013 in couterpart Japanese Patent Application No. 2012-544403 (6 pages, in Japenese with English translation).

* cited by examiner

RECONFIGURABLE BASE STATION ANTENNA

CROSS-REFERENCE TO RELATED APPLICATION(S)

This application is a National Phase entry of PCT Application No. PCT/KR2010/009175, filed on Dec. 21, 2010, which claims priority under 35 U.S.C. §119(e), 120 and 365 (c) to Korean Patent Application No. 10-2009-0128482, filed on Dec. 21, 2009, in the Korean Intellectual Property Office, the entire disclosures of which are both incorporated herein by reference for all purposes.

BACKGROUND OF THE INVENTION

1. Field of the Invention

The present invention relates to a base station antenna, and more particularly to a base station antenna supporting multiple antenna schemes.

2. Description of the Related Art

Development of mobile communication technology is followed by expectations that, even before the 3G ($3^{rd}$ Generation) networks are saturated, 4G ($4^{th}$ Generation) networks will be constructed widely. One of international standards representing the 4G networks, i.e. Mobile WiMAX or LTE (Long Term Evolution) communication scheme, applies various technologies to increase the transmission rate per frequency band, i.e. capacity (bps/Hz), and, for the purpose of the most effective capacity increase, applies multiple antenna technology referred to as MIMO (Multi-Input Multi-Output).

The essentials of multiple antenna technology for base station antennas are based on baseband signal processing technology. However, the degree of capacity increase, when multiple antennas are used, heavily depends on the antenna configuration. The reason is as follows: the multiple antenna technology makes active use of a number of multi-path fading and, at the same time, seeks to remove interference signals from other subscribers. This means that, even if the antenna configuration is the same, the degree of capacity increase varies depending on the wave propagation environment and subscriber distribution of the area covered by the base station. Therefore, international standards do not include particulars regarding the antenna configuration and allow free installation of antennas, based on field situations, to maximize the capacity.

However, conventional multiple antenna technologies have a limitation in that, since the antenna beam is fixed, capacity increase can not be expected, once installation is completed, in adaptive response to the wave propagation environment and subscriber distribution, but solely by using baseband signal processing technology. If necessary, the operator may, for example, climb the tower and modify the antennas themselves or their configuration. However, this approach requires a large amount of time and budget for modification and optimization and cannot easily handle situations having time-varying wave propagation environment and subscriber distribution. In summary, conventional antenna technologies cannot reflect the condition of communication environment in real time to perform load balancing, and provide no method for directing the antenna beam towards a hotspot area at a remote location.

SUMMARY OF THE INVENTION

Accordingly, the present invention has been made to solve the above-stated problems occurring in the prior art, and the present invention provides a base station antenna capable of variously modifying the radiation direction of antenna beams at a remote location in response to wave propagation environment and subscriber distribution.

Further, the present invention provides a base station antenna capable of increasing cell capacity by modifying the antenna configuration in response to wave propagation environment and subscriber distribution.

Further, the present invention provides a base station antenna capable of reflecting the condition of communication environments in real time, performing a load balancing function accordingly, and directing antenna beams towards a hotspot area.

Further, the present invention provides a base station antenna configured to prevent distortion of its upper or lower portion during antenna angle modification.

In accordance with an aspect of the present invention, there is provided a base station antenna including: at least two reflection plates each having at least one radiation element; a radome forming an internal cavity and containing the at least two reflection plates; first and second caps coupled to cover openings formed on upper and lower portions of the radome, respectively; a reflection plate connection member connected to each of the at least two reflection plates and to the first and second caps so that the at least two reflection plates can rotate; a reflection plate rotation driving unit including at least one power generation unit configured to provide rotation power and at least one power transmission mechanism unit configured to provide at least one reflection plate with rotation power from the power generation unit and control the rotation angle of the reflection plate provided with the rotation power, one of the power generation unit and the power transmission mechanism unit being coupled to the at least two reflection plates, and the other being coupled to the first cap; a reflection plate retention unit coupled to the at least two reflection plates and to the second cap to guide rotation and retention of the reflection plates; and a reflection plate control unit configured to provide the reflection plate rotation driving unit and the reflection plate retention unit with a control signal for controlling rotation and standstill of the at least two reflection plates.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENT

Hereinafter, the exemplary embodiments of the present invention will be described with reference to the accompanying drawings in detail. Further, various specific definitions found in the following description are provided only to help general understanding of the present invention, and it will be understood by those skilled in the art that various changes and modifications can be made thereto within the technical spirit and scope of the present invention. In the following description, a detailed explanation of known related functions and constitutions may be omitted to avoid unnecessarily obscuring the subject matter of the present invention.

Construction of a new communication service network (e.g. 4G network), while an existing communication service network (e.g. 2G or 3G network) is still being used to provide a mobile communication service, requires installation of a new base station site at a high cost. Therefore, construction of a new communication service network (e.g. 4G) using a site, which has an existing communication service network (e.g. 2G or 3G) installed therein, reduces the cost to install a new base station site. This means that construction of a new communication service network requires co-siting installation. More specifically, antennas necessary for the next-generation communication service network need to be installed together with antennas of the previously-constructed base station tower.

The present invention proposes a base station antenna which forms remotely-controllable antenna beams and adaptively modifies them in conformity with wave propagation environment and subscriber distribution, thereby maximizing capacity increase through multiple antenna technology. In addition, the direction of antenna beams is adjusted based on subscriber distribution to support an inter-sector load balancing function, the antenna beams can be directed towards a hotspot area within the service area, and, when the antenna angle is modified to direct the antenna beams, distortion of the upper or lower portion of the antenna is prevented.

Figure 1A:
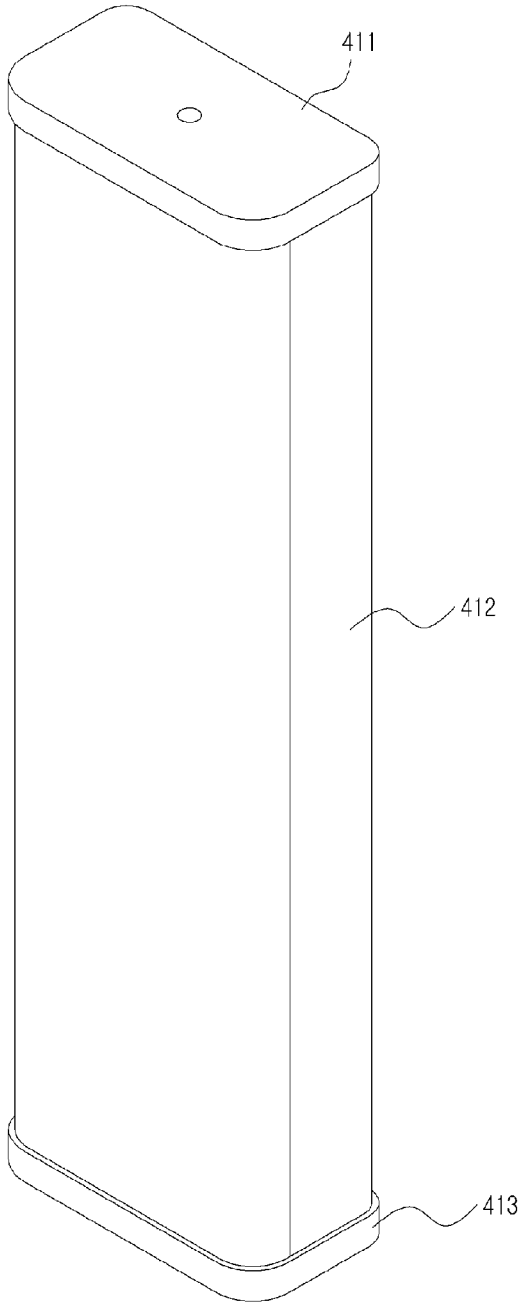
FIG. 1*a* is a perspective view of a base station antenna according to a first embodiment of the present invention.
Figure 1B:
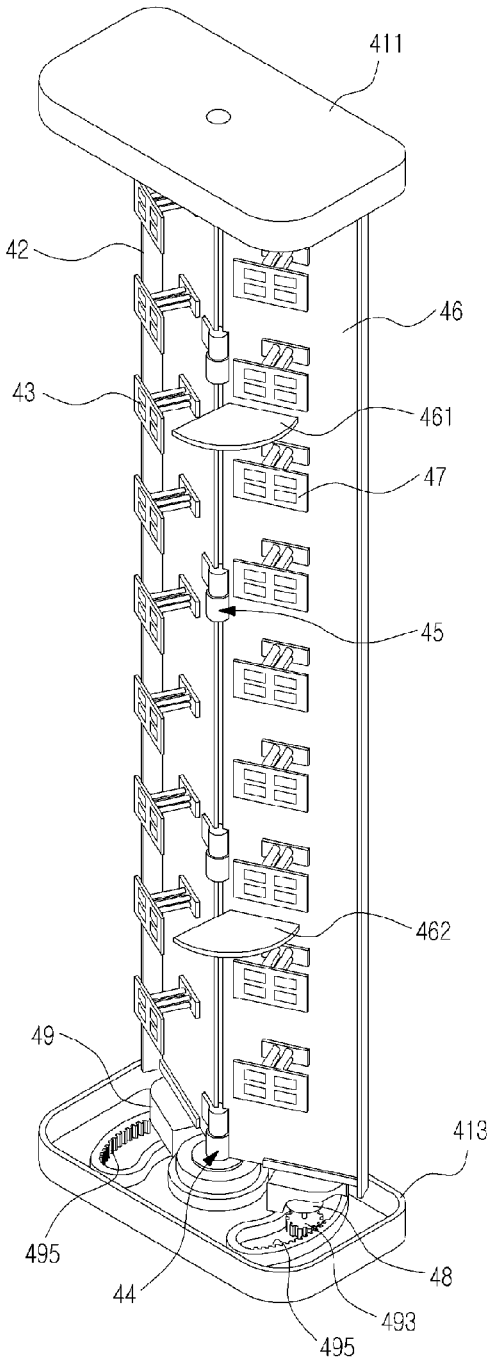
FIG. 1*b* is a perspective view of the base station antenna shown in FIG. 1*a*, with its radome removed.

FIG. 1*a* is a perspective view of a base station according to a first embodiment of the present invention, and FIG. 1*b* is a perspective view of the base station antenna shown in FIG. 1*a*, with its radome removed.

Referring to FIG. 1*a*, the base station antenna according to the first embodiment of the present invention has a contour defined by a radome 412, the upper and lower portions of which are covered by upper and lower caps 411 and 413, respectively.

Referring to FIG. 1*b*, inside the radome 412 are installed a plurality of radiation elements 43 and 47, a first reflection plate 42, a second reflection plate 46, and various types of equipment for retaining the plurality of radiation elements 43 and 47 and the first and second reflection plates 42 and 46. Specifically, a base station antenna according to an embodiment of the present invention has reflection plate connection members 44 and 45 for rotatably retaining the plurality of radiation elements 43 and 47 and the first and second reflection plates 42 and 46, as well as reflection plate rotation driving units 48, 493, and 495 for controlling rotation of the plurality of radiation elements 43 and 47 and the first and second reflection plates 42 and 46 at a remote location. The reflection plate rotation driving units 48, 493, and 495 include at least one power generation unit 48 and power transmission mechanism units 493 and 495.

The reflection plate connection members 44 and 45 include a first hinge 44 fixed to the upper cap 411 and/or the lower cap 413 and a second hinge 45 mounted between the first and second reflection plates 42 and 46.

The power generation units 48 of the reflection plate rotation driving units are configured to receive control signals from a remote location and generate power, in response to the control signals, to rotate the first and second reflection plates 42 and 46 and may be a motor, for example.

The power transmission mechanism units 493 and 495 of the reflection plate rotation driving units include external gears 493 fixed to the rotation shafts of the power generation units 48 and internal gears 495 formed on the lower cap 413 in conformity with the path of movement of the external gears 493, which is defined by rotation of the first and second reflection plates 42 and 46. This structure of the power transmission mechanism units 493 and 495 enables the base station antenna according to the present invention to drive the power generation units 48 based on control signals necessary to control rotation of the first and second reflection plates 42 and 46 at a remote location and, accordingly, control the rotation angle of the first and second reflection plates 42 and 46. The base station antenna may further include auxiliary caps 49 for containing the power generation units 48.

Those skilled in the art can understand that, although components of the power transmission mechanism units 493 and 495 have been exemplified as devices for rotating the first and second reflection plates 42 and 46 according to an embodiment of the present invention, the present invention is not limited thereto, and the power transmission mechanism units 493 and 495 may be structured in any manner as long as rotation of the first and second reflection plates 42 and 46 can be controlled by rotation power provided by the power generation units 48.

In addition, the present invention is not limited to the exemplary external and internal gears 493 and 495, which constitute the power transmission mechanism units 493 and 495 according to an embodiment of the present invention, and the power transmission mechanism units 493 and 495 may have any structure as long as rotation of the reflection plates 42 and 46 is controlled using control signals from a remote location.

According to another embodiment of the present invention, the reflection plate rotation driving units 48, 493, and 495 may be installed on the top portions of the first and second reflection plates 42 and 46.

The base station antenna according to the first embodiment of the present invention further includes reflection plate guide units configured to support vibration reinforcement for the first and second reflection plates 42 and 46 and guide the rotation and retention of the reflection plates. Detailed construction of the reflection plate guide units is exemplified in FIGS. 2, 3, 4*a*, and 4*b*.

Figure 2:
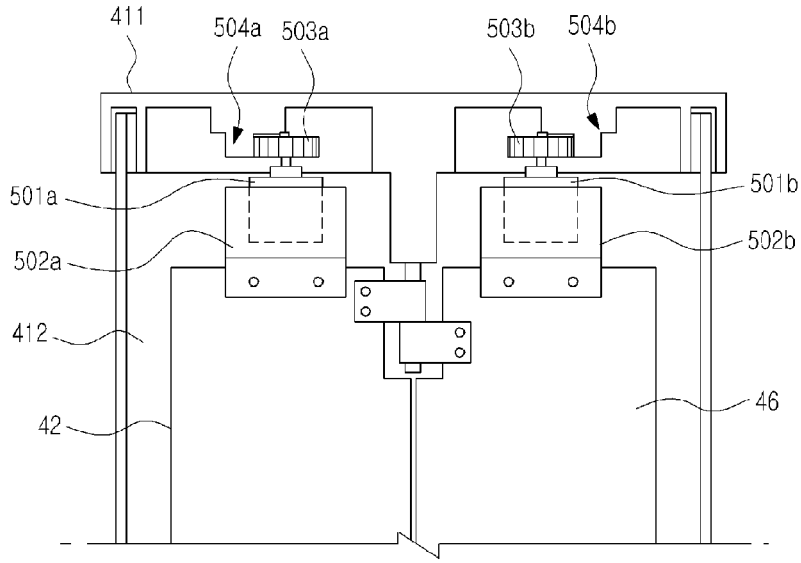
FIG. 2 is a sectional view illustrating a first example of reflection plate guide units of the base station antenna according to the first embodiment of the present invention.
Figure 3:
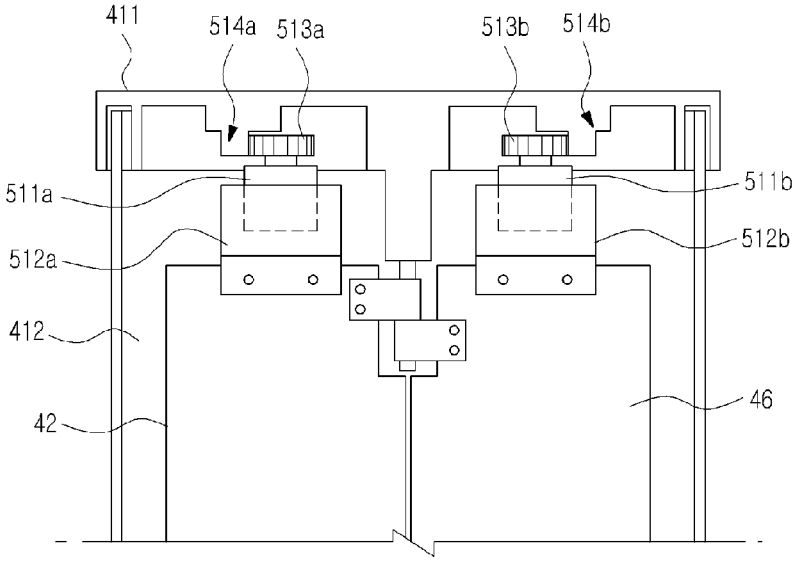
FIG. 3 is a sectional view illustrating a second example of reflection plate guide units of the base station antenna according to the first embodiment of the present invention.
Figure 4A:
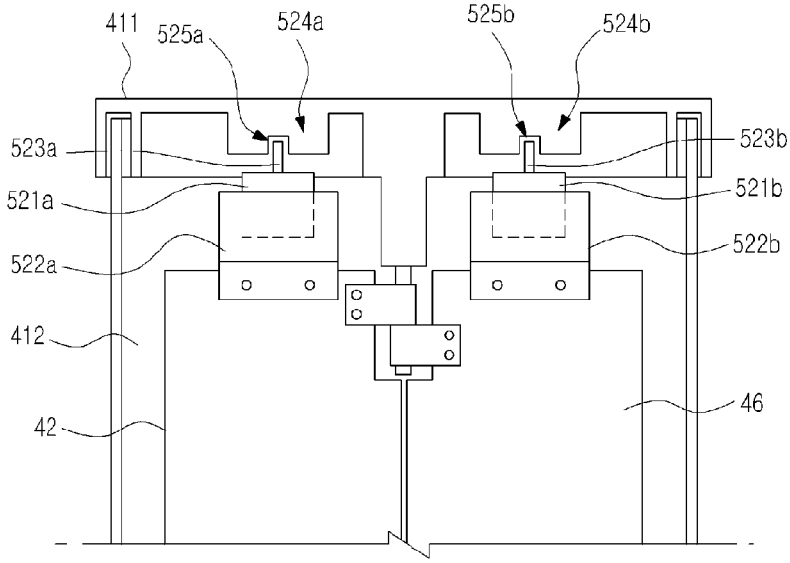
FIG. 4*a* is a sectional view illustrating a third example of reflection plate guide units of the base station antenna according to the first embodiment of the present invention.
Figure 4B:
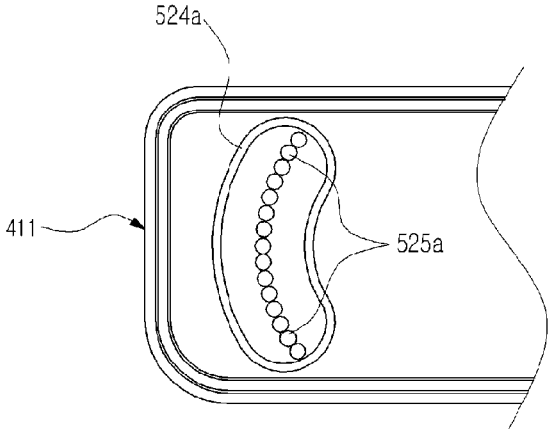
FIG. 4*b* is a partial top view of the upper cap, to which first and second retention units are coupled, shown in FIG. 4*a;*
Figure 5A:
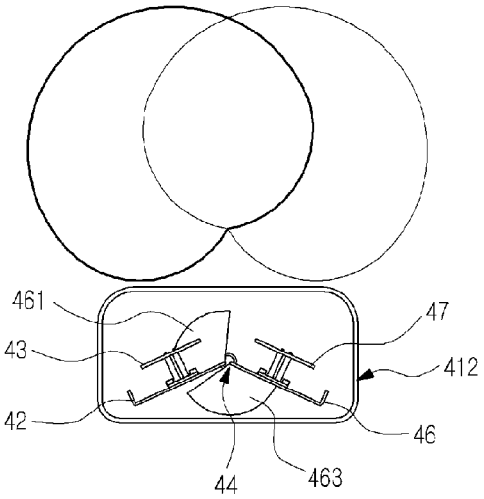
FIGS. 5*a* to 5*e* illustrate exemplary beam patterns, which are radiated from the base station antenna shown in FIG. 1, and their directions.
Figure 5B:
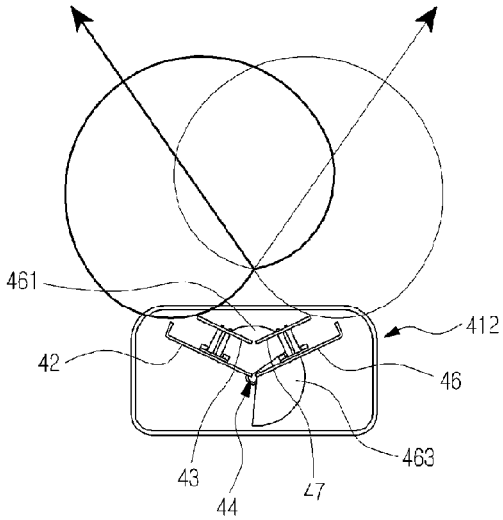
Figure 5C:
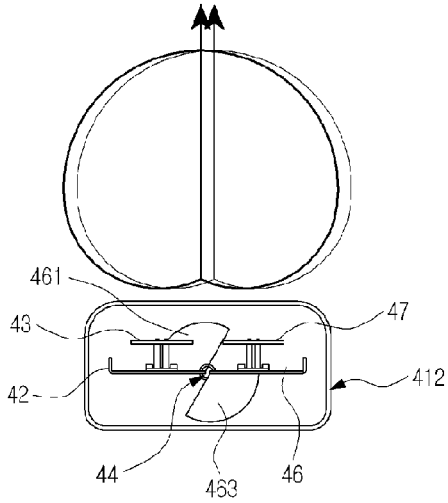
Figure 5D:
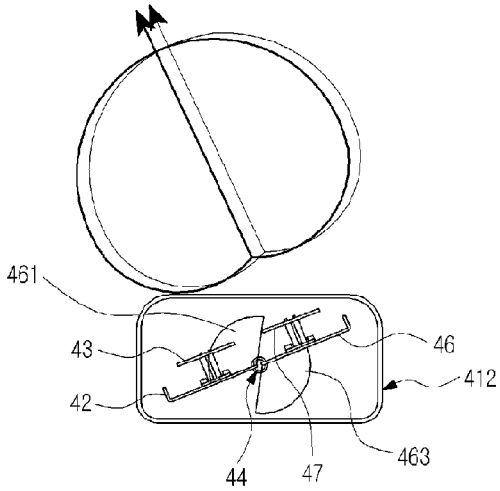
Figure 5E:
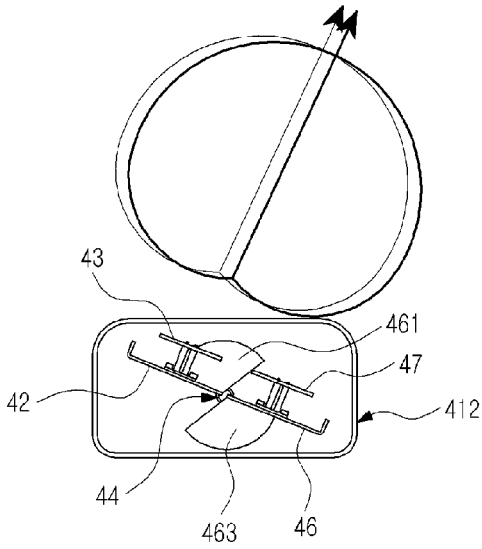

FIG. 2 is a sectional view illustrating a first example of the reflection plate guide units, FIG. 3 is a sectional view illustrating a second example of the reflection plate guide units, and FIGS. 4*a* and 4*b* are sectional views illustrating a third example of the reflection plate guide units.

Referring to FIG. 2, the first example of the reflection plate guide units 501*a*, 502*a*, 503*a*, 504*a*, 501*b*, 502*b*, 503*b*, and 504*b* may have reflection plate retention driving units 501*a* and 501*b* to have a structure similar to that of the reflection plate rotation driving units 48, 493, and 495. Specifically, the reflection plate guide units 501*a*, 502*a*, 503*a*, 504*a*, 501*b*, 502*b*, 503*b*, and 504*b* include reflection plate retention driving units 501*a* and 501*b* coupled to the first and second reflection plates 42 and 46 through retention members 502*a* and 502*b*, respectively. The reflection plate guide units 501*a*, 502*a*, 503*a*, 504*a*, 501*b*, 502*b*, 503*b*, and 504*b* also include small external gears 503*a* and 503*b* and internal gears 501*a* and 501*b*. The small external gears 503*a* and 503*b* are coupled to rotation shafts of the reflection plate retention driving units 501*a* and 501*b*, and the internal gears 504*a* and 504*b* are formed on the upper cap 411 in conformity with the path of movement of the small external gears 503*a* and 503*b*. The reflection plate retention driving units 501*a* and 501*b* of the reflection plate guide units exemplified in FIG. 2 may be controlled based on interworking with control signals for controlling the power generation units 48. Specifically, driving of the power generation units 48 of the reflection plate rotation driving units is followed by driving of the reflection plate retention driving units 501*a* and 501*b* of the reflection plate guide units, and both the upper and lower portions of the first and second reflection plates 42 and 46 rotate at the same rate and angle. On the other hand, when the power generation units 48 of the reflection plate rotation driving units do not rotate and the power transmission mechanism units 493 and 495 retain the lower position of the first and second reflection plates 42 and 46, the reflection plate retention driving units 501*a* and 501*b* of the reflection plate guide units do not rotate either, but retain the upper position of the first and second reflection plates 42 and 46 through the small external gears 503*a* and 503*b* and the internal gears 504*a* and 504*b*.

A second example of the reflection plate guide units, as shown in FIG. 3, may have non-excited brakes 511*a* and 511*b* as an alternative to the reflection plate retention driving units 501*a* and 501*b* of the first example. Specifically, the reflection plate guide units 511*a*, 512*a*, 513*a*, 514*a*, 511*b*, 512*b*, 513*b*, and 514*b* of the second example may include, in order to guide the movement of the first and second reflection plates 42 and 46, non-excited brakes 511*a* and 511*b* retained through retention members 512*a* and 512*b* coupled to the first and second reflection plates 42 and 46, respectively, small external gears 513*a* and 513*b* coupled to rotation shafts of the non-excited brakes 511*a* and 511*b*, and internal gears 514*a* and 514*b* formed on the upper cap 411 in conformity with the path of movement of the small external gears 513*a* and 513*b*.

The non-excited brakes 511*a* and 511*b* of the reflection plate guide units exemplified in FIG. 3 may be controlled based on interworking with control signals for controlling the power generation units 48. Specifically, during input of an actuation signal for rotation driving into the power generation units 48 of the reflection plate rotation driving units, the actuation signal is also inputted into the non-excited brakes 511*a* and 511*b* of the reflection plate guide units, and the small external gears 513*a* and 513*b*, which are coupled to the non-excited brakes 511*a* and 511*b*, then enable the first and second reflection plates 42 and 46 to rotate. Since the small external gears 513*a* and 513*b* coupled to rotation shafts of the non-excited brakes 511*a* and 511*b* are enabled to rotate, and since the power generation units 48 begin driving, the first and second reflection plates 42 and 46 are guided along the path provided by the small external gears 513*a* and 513*b* and the internal gears 514*a* and 514*b*. On the other hand, during input of a signal to deactivate the power generation units 48 of the reflection plate rotation driving units, the deactivation signal is also inputted to the non-excited brakes 511*a* and 511*b* of the reflection plate guide units, which then prevent the first and second reflection plates 42 and 46 from rotating. As a result, the small external gears 513*a* and 513*b* coupled to the non-excited brakes 511*a* and 511*b* engage with the internal gears 514*a* and 514*b* and retain the upper portion of the first and second reflection plates 42 and 46.

A third example of the reflection plate guide units, as shown in FIG. 4*a*, may have solenoid units 521*a*, 521*b*, 523*a*, and 523*b*, which include coil bodies 521*a* and 521*b* and retention pins 523*a* and 523*b*, as an alternative to the reflection plate retention driving units 501*a* and 501*b* of the first example.

The third example of the reflection plate guide units 521*a*, 522*a*, 523*a*, 524*a*, 521*b*, 522*b*, 523*b*, and 524*b* have solenoid units 521*a*, 521*b*, 523*a*, 523*b* for guiding the movement of the first and second reflection plates 42 and 46, as well as first and second retention pin reception arrays 524*a* and 524*b*. The solenoid units 521*a*, 521*b*, 523*a*, and 523*b* are coupled to the first and second reflection plates 42 and 46, respectively, and the first and second retention pin reception arrays 524*a* and 524*b* are provided on the upper cap 411 to retain the first and second reflection plates 42 and 46 in a rotated state. The first and second retention pin reception arrays 524*a* and 524*b* have the same structure, and detailed construction of the first retention pin reception array 524*a* will now be described with reference to FIG. 4*b*, without repeating the same for the second retention pin reception array 524*b*. The first retention pin reception array 524*a* is coupled to the upper cap 411 and has a plurality of retention holes 525*a* configured to receive the retention pin 523*a* of the solenoid units 521*a*, 521*b*, 523*a*, and 523*b*. The plurality of retention holes 525*a* are positioned to correspond to the path of rotational movement of the first reflection plate 42.

The reflection plate guide units 521*a*, 522*a*, 523*a*, 524*a*, 521*b*, 522*b*, 523*b*, and 524*b* are configured to operate based on interworking with control signals inputted to the power generation units 48. To be specific, during input of an actuation signal for rotation driving into the power generation units 48 of the reflection plate rotation driving units, the actuation signal is inputted to the coil bodies 521*a* and 521*b* of the solenoid units, causing a current flow. The retention pins 523*a* and 523*b* are then pulled toward the coil bodies 521*a* and 521*b* and withdrawn from the first and second retention pin reception arrays 524*a* and 524*b*. On the other hand, during input of a signal to deactivate the power generation units 48 of the reflection plate rotation driving units, the deactivation signal is inputted to the coil bodies 521*a* and 521*b* of the solenoid units 521*a*, 521*b*, 523*a*, and 523*b*, allowing no more current flow. The retention pins 523*a* and 523*b* are then drawn towards the retention holes 525*a* and 525*b* of the first and second retention pin reception arrays 524*a* and 524*b*. In other words, the structure of the reflection plate guide units 521*a*, 522*a*, 523*a*, 524*a*, 521*b*, 522*b*, 523*b*, and 524*b* shown in FIGS. 4*a* and 4*b* provides the following operation: during rotation of the power generation units 48 of the reflection plate rotation driving units, the retention pins 523*a* and 523*b* are pulled towards the coil bodies 521*a* and 521*b* and withdrawn from the first and second retention pin reception arrays 524*a* and 524*b*, allowing the first and second reflection plates 42 and 46 to rotate freely. On the other hand, during no rotation of the power generation units 48 of the reflection plate rotation driving units, the retention pins 523*a* and 523*b* are pulled into the retention holes 525*a* and 525*b* of the first and second retention pin reception arrays 524*a* and 524*b* to retain the first and second reflection plates 42 and 46.

Referring to FIG. 1*b* again, the base station antenna according to the first embodiment of the present invention may further include at least one rotation limit 461 and 462 for controlling the rotation angle of the first and second reflection plates 42 and 46.

The rotation limits 461 and 462 may be coupled to the front surface (e.g. surface on which the plurality of radiation elements 43 and 47 are mounted) and the rear surface of the first and second reflection plates 42 and 46 so as to cross each other. Specifically, at least one of the rotation limits 461 and 462 may be coupled to the front surface (e.g. surface on which the plurality of radiation elements 43 and 47 are mounted) of the second reflection plate 46, as shown in FIG. 1*b*, and at least one on the rear surface of the first reflection plate 42.

Alternatively, a set of rotation limits 461 and 462 may be mounted on the front surfaces (e.g. surfaces on which the plurality of radiation elements 43 and 47 are mounted) of the first and second reflection plates 42 and 46, respectively, and another set on the rear surface thereof, respectively.

The rotation limits 461 and 462 may have the shape of a circular sector or a triangle, which has an angle (e.g. inner angle of 120°) determined to control the rotation of the first and second reflection plates 42 and 46.

One ends of the rotation limits 461 and 462 of the above-mentioned structure are coupled to the first and second reflection plates 42 and 46, which are then allowed to rotate within a first angle range. If the first and second reflection plates 42 and 46 rotate out of a second angle range, the other ends of the rotation limits 461 and 462 contact them and prevent further rotation.

Those skilled in the art can understand that, although the rotation limits 461 and 462 are coupled to the front and rear surfaces of the first and second reflection plates 42 and 46 so as to cross each other, or coupled to both the front and rear surfaces thereof, and have the shape of a circular sector or a triangle according to the first embodiment of the present invention, the present invention is not limited to the exemplary structure of the rotation limits, the coupling position or shape of which can be modified variously as long as they can limit the rotation angle of the first and second reflection plates 42 and 46.

FIGS. 5*a* to 5*e* exemplify beam patterns radiated from the base station antenna shown in FIG. 1*b*, as well as their directions. The reflection plates 42 and 46 of the base station antenna according to the first embodiment of the present invention, as described above, can rotate as shown in FIGS. 5*a* to 5*e*. Furthermore, the base station antenna according to the present invention can support an inter-sector load balancing function, direct antenna beams to a hotspot area within the service area, and variously modify the section management of the base station.

Figure 6:
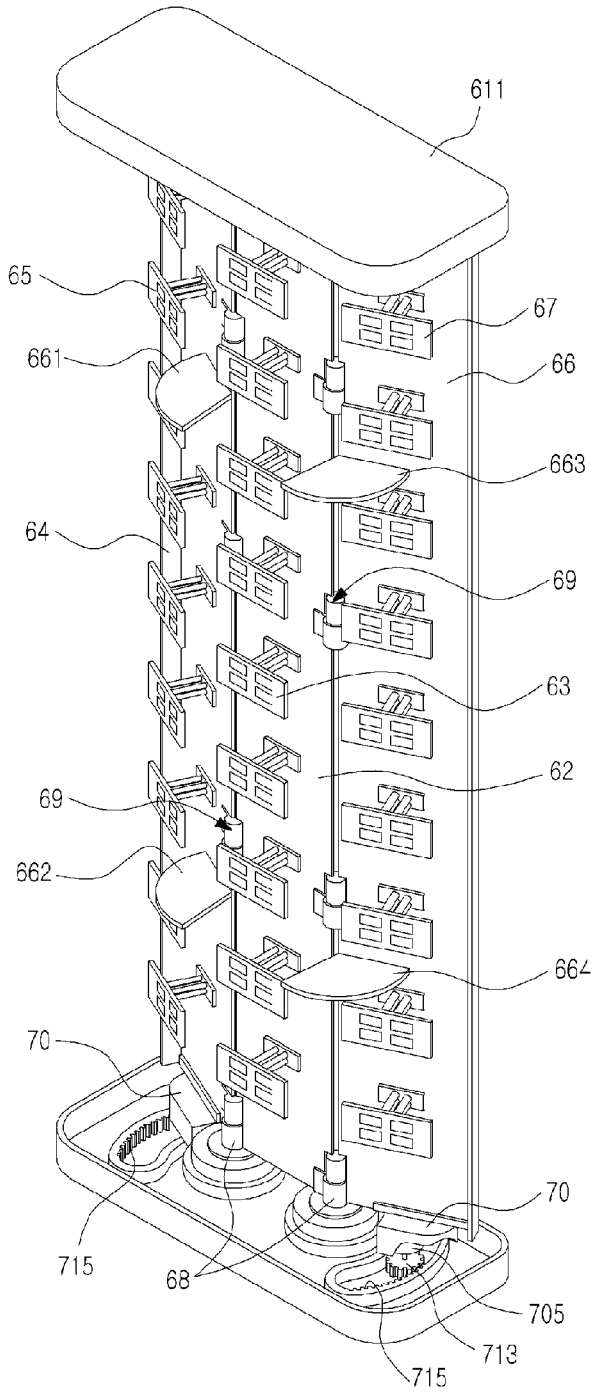
FIG. 6 is a perspective view of a base station antenna according to a second embodiment of the present invention.
Figure 7A:
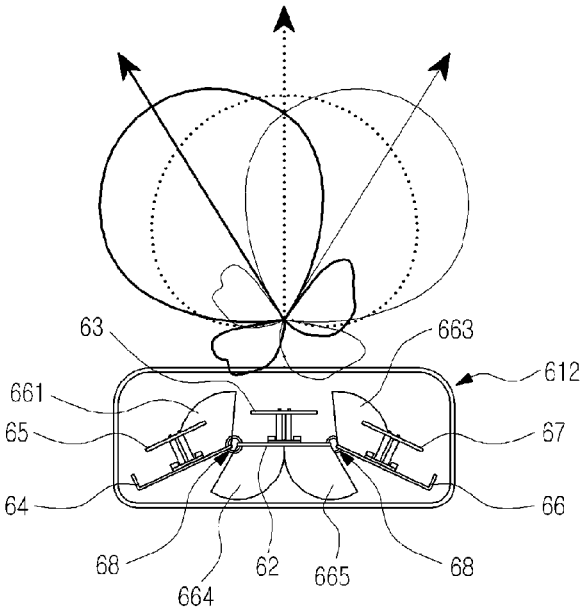
FIGS. 7*a* to 7*e* illustrate exemplary beam patterns, which are radiated from the base station antenna shown in FIG. 6, and their directions.
Figure 7B:
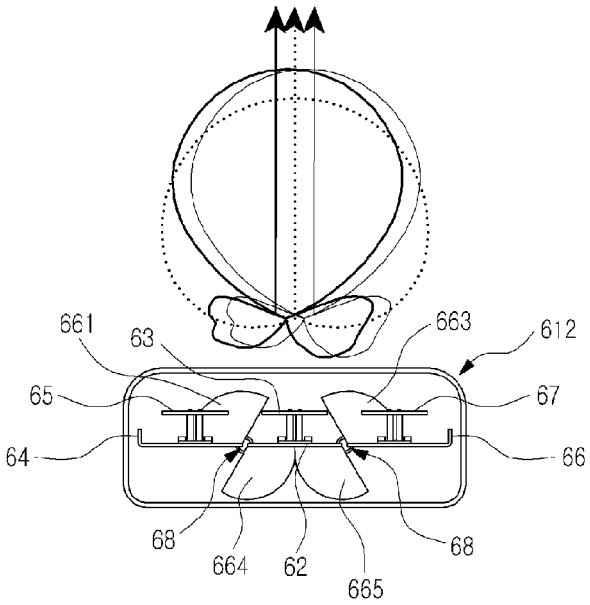
Figure 7C:
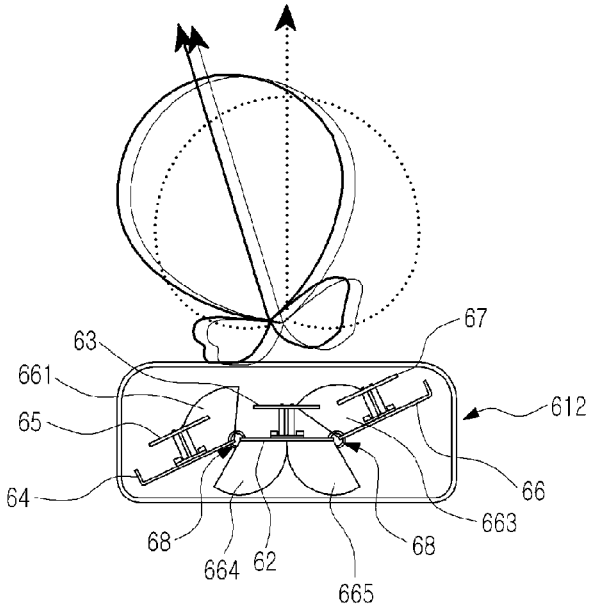
Figure 7D:
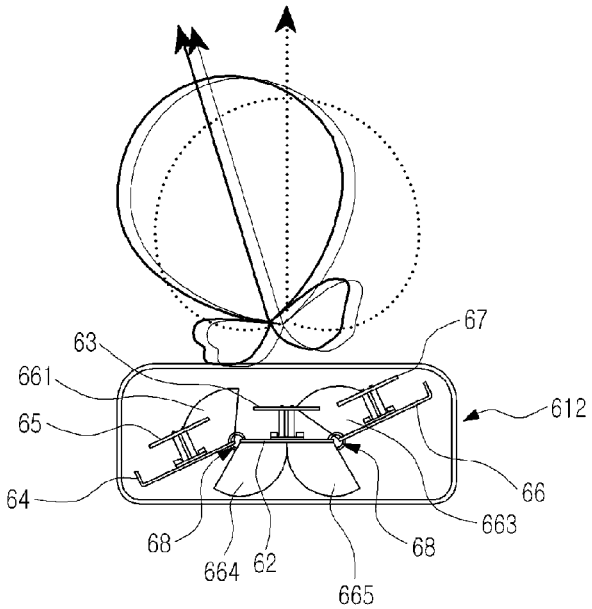
Figure 7E:
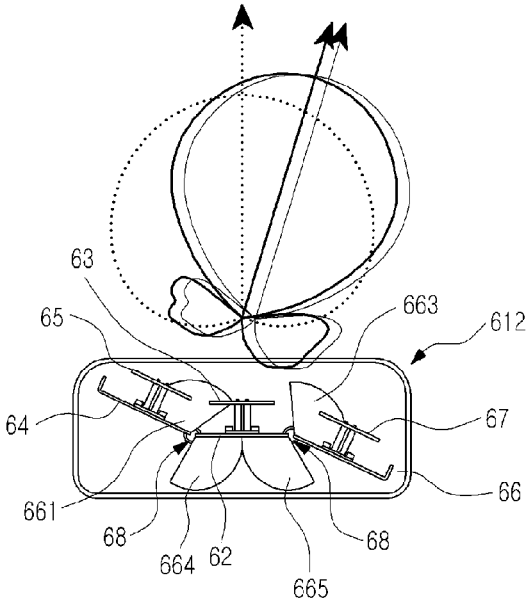

FIG. 6 is a perspective view of a base station antenna according to a second embodiment of the present invention, and FIGS. 7*a* to 7*e* illustrate exemplary beam patterns, which are radiated from the base station antenna shown in FIG. 6, and directions.

The base station antenna according to the second embodiment of the present invention has the same structure as the base station antenna according to the first embodiment, except for a difference in the number of reflection plates inside the radome 612 and the construction of equipment for rotation of the reflection plates.

To be specific, the base station antenna according to the second embodiment has three reflection plates, i.e. first, second, and third plates 62, 64, and 66 inside the radome 612. With the first reflection plate 62 at the center, the second and third reflection plates 64 and 66 are positioned on both sides, respectively, and are connected to the first reflection plate 62 through reflection plate connection members 68 and 69, respectively. The reflection plate connection members 68 and 69 are configured to retain the position of the first reflection plate 62 and to allow the second and third reflection plates 64 and 66 to rotate about center shafts of the reflection plate connection members 68 and 69.

The base station antenna further includes, in order to control rotation of the second and third reflection plates 64 and 66 at a remote location, power generation units 705 and power transmission mechanism units 713 and 715. The power transmission mechanism units 713 and 715 may include, as in the case of the first embodiment, external gears 713 and internal gears 715.

The power transmission mechanism units 713 and 715 may further include auxiliary caps 70 for containing the power generation units 705, and the auxiliary caps 70 may be mounted on the second and third reflection plates 64 and 66, respectively.

The above-mentioned structure of the power generation units 705 and the power transmission mechanism units 713 and 715 enables the base station antenna to receive signals to control the power generation units 705, which are necessary to control rotation of the second and third reflection plates 64 and 66, from a remote location and, based on driving of the power generation units 705, control the rotation angle of the second and third reflection plates 64 and 66. As a result, the second and third reflection plates 64 and 66 can be rotated by the power generation units 705 as shown in FIGS. 7*a* to 7*e*.

The base station antenna according to the second embodiment further includes reflection plate guide units configured to support vibration reinforcement for the reflection plates 62, 64, and 66 and to guide the rotation and retention of the reflection plates 62, 64, and 66. The reflection plate guide units may have a construction and a structure similar to those of the reflection plate guide units of the base station antenna according to the first embodiment. Therefore, the structure of the reflection plate guide units according to the first embodiment will be referred to, instead of describing the same again.

The base station antenna according to the second embodiment of the present invention may further include at least one rotation limit 661, 662, 663, and 664 to determine the rotation angle of the first, second, and third reflection plates 62, 64, and 66. Those skilled in the art can understand that the coupling position or shape of the rotation limits 661, 662, 663, and 664 can be modified variously as long as it can control the rotation angle of the second and third reflection plates 64 and 66.

The above-mentioned structure of the base station antenna according to the second embodiment of the present invention makes it possible to simultaneously emit signals for providing different communication services through the first, second, and third reflection plates 62, 64, and 66. Assuming that 2G (or 3G) and 4G communication services are provided in a co-siting manner, it is possible to emit signals for providing the 2G (or 3G) communication service through the first reflection plate 62 and emit signals for providing the 4G communication service through the second and third reflection plates 64 and 64. Therefore, the base station antenna according to the second embodiment of the present invention has a considerable merit when a 2G (or 3G) communication service is still provided and a 4G network is newly constructed in a co-siting manner. Specifically, the existing 2G (or 3G) communication antenna is retained at the center, and new 4G communication antennas are provided on both sides. This can reduce signal correlation to a suitable level and create a proper level of space diversity. Furthermore, the mechanism-based adjustment of the radiation direction of antenna beams by the power generation units 705 and the power transmission mechanism units 713 and 715 creates a pattern diversity effect. In addition, the base station antenna according to the second embodiment of the present invention can, even if the newly designed communication network (e.g. 4G communication service network) differs from the previous communication network (e.g. 3G communication service network), operate the co-siting flexibly through control of beam radiation direction.

Furthermore, proper association of the base station antenna according to the present invention with baseband signal processing technology and combined operation can lead to evolution to HMAT (Hybrid Multiple Antenna Technology), which provides optimized operation of mobile communication networks. The optimized operation of mobile communication networks, in this connection, means that signal processing related to individual subscribers is performed in the baseband, and antenna beam formation based on subscriber distribution is performed by the base station antenna according to the present invention.

The base station antenna according to the present invention has the following advantageous effects:

First, control of the directing angle of a plurality of reflection plates inside one radome at a remote location makes it possible to reflect the condition of communication environments in real time, to perform a load balancing function accordingly, and to direct antenna beams towards a hotspot area without any limitation on space and time.

Second, reflection plates provided inside one radome are operated as antennas for different service networks so that co-siting is possible, i.e. different services can be provided simultaneously.

Third, antenna configuration is modified in response to wave propagation environment and subscriber distribution, thereby increasing cell capacity.

Fourth, during modification of the antenna directing angle, distortion of the upper or lower portion of the antenna is prevented.

While the present invention has been shown and described with reference to certain exemplary embodiments and drawings thereof, it will be understood by those skilled in the art that various changes in form and details may be made therein without departing from the spirit and scope of the invention as defined by the appended claims.

What is claimed is:

1. A base station antenna comprising:

at least two reflection plates each having at least one radiation element;

a radome forming an internal cavity and containing the at least two reflection plates;

first and second caps coupled to cover openings formed on upper and lower portions of the radome, respectively;

a reflection plate connection member connected to each of the at least two reflection plates and to the first and second caps so that the at least two reflection plates can rotate;

a reflection plate rotation driving unit comprising at least one power generation unit configured to provide rotation power and at least one power transmission mechanism unit configured to provide at least one reflection plate with rotation power from the power generation unit and control the rotation angle of the reflection plate provided with the rotation power, one of the power generation unit and the power transmission mechanism unit being coupled to the at least two reflection plates, and the other being coupled to the first cap;

a reflection plate retention unit coupled to the at least two reflection plates and to the second cap to guide rotation and retention of the reflection plates; and a reflection plate control unit configured to provide the reflection plate rotation driving unit and the reflection plate retention unit with a control signal for controlling rotation and standstill of the at least two reflection plates.

2. The base station antenna as claimed in claim 1, wherein the reflection plate retention unit comprises:

at least one auxiliary power generation unit configured to provide rotation power in response to the control signal; and at least one auxiliary power transmission mechanism unit configured to provide at least one reflection plate with rotation power from the auxiliary power generation unit and control the rotation angle of the reflection plate provided with the rotation power.

3. The base station antenna as claimed in claim 2, wherein the auxiliary power transmission mechanism unit comprises at least one external gear mounted on one side of the auxiliary power generation unit and an internal gear provided on the first cap along a movement radius of the at least one external gear.

4. The base station antenna as claimed in claim 1, wherein the reflection plate retention unit comprises:

a reflection plate retention driving unit controlled to retain the reflection plates onto the second cap, in response to the control signal, while the power generation unit provides no rotation power; and at least one reflection plate retention mechanism unit configured to maintain the reflection plates and the second cap in a retained condition.

5. The base station antenna as claimed in claim 4, wherein the reflection plate retention driving unit comprises a non-excited brake configured to retain the reflection plates while the power generation unit provides no rotation power, and the reflection plate retention mechanism unit comprises at least one external gear coupled to the non-excited brake and an internal gear provided on the second cap along the movement radius of the at least one external gear.

6. The base station antenna as claimed in claim 4, wherein the reflection plate retention driving unit comprises a solenoid unit having a retention pin configured to protrude while the power generation unit provides no rotation power, and the reflection plate retention mechanism unit comprises a retention pin reception array having at least one hole formed to receive the retention pin and retain positions of the reflection plates.

7. The base station antenna as claimed in claim 1, wherein the power transmission mechanism unit comprises at least one external gear mounted on one side of the power generation unit and an internal gear provided on the first cap along a movement radius of the at least one external gear.

8. The base station antenna as claimed in claim 1, further comprising a rotation limit coupled to at least one of the at least two reflection plates to control the rotation angle of the at least two reflection plates.

9. The base station antenna as claimed in claim 8, wherein the rotation limit comprises:

first limits coupled to front portions of the reflection plates to control the front rotation angle of the reflection plates; and second limits coupled to rear portions of the reflection plates to control the rear rotation angle of the reflection plates.

10. The base station antenna as claimed in claim 9, wherein one ends of the first and second limits are fixed to the at least one reflection plate, and, during rotation of the reflection plate, other ends of the first and second limits contact the other reflection plate adjacent to the at least one reflection plate so that rotation of the reflection plates is controlled.

11. The base station antenna as claimed in claim 1, further comprising at least two rotation limits coupled to the at least two reflection plates, respectively, to control the rotation angle of the at least two reflection plates.

12. The base station antenna as claimed in claim 1, wherein the base station antenna comprises a first reflection plate positioned at the center and second and third reflection plates positioned on both sides of the first reflection plate, respectively, the first reflection plate has a fixed beam radiation direction, and the second and third reflection plates have a radiation angle adjusted by the power generation unit and the power transmission mechanism unit.

13. A base station antenna comprising:

at least one power generation unit configured to provide rotation power;

at least one power transmission mechanism unit configured to provide at least one reflection plate with rotation power from the power generation unit and control the rotation angle of the at least one reflection plate provided with the rotation power; and a reflection plate retention unit coupled to the at least one reflection plate and to at least one of caps mounted on upper and lower portions of an antenna radome, respectively, to retain the at least one reflection plate, wherein one of the power generation unit and the power transmission mechanism unit is coupled to the at least one reflection plate, and the other is coupled to the cap.

14. The base station antenna as claimed in claim 13, wherein the reflection plate retention unit is configured to retain the at least one reflection plate while no rotation power is being provided and is implemented by one selected from the group consisting of a motor, a non-excited brake, and a solenoid unit.

* * * * *